US006170301B1

(12) United States Patent
Stoll et al.

(10) Patent No.: US 6,170,301 B1
(45) Date of Patent: Jan. 9, 2001

(54) METHOD FOR PRODUCING A KNITTED ARTICLE ON A FLAT KNITTING MACHINE

(75) Inventors: Thomas Stoll; Franz Schmid, both of Reutlingen (DE)

(73) Assignee: H. Stoll GmbH & Co., Reutlingen (DE)

( * ) Notice: Under 35 U.S.C. 154(b), the term of this patent shall be extended for 0 days.

(21) Appl. No.: 09/231,865

(22) Filed: Jan. 13, 1999

(30) Foreign Application Priority Data

Jan. 17, 1998 (DE) ..... 198 01 643

(51) Int. Cl.[7] ..... D04B 15/46
(52) U.S. Cl. ..... 66/126 R; 66/125 R; 66/146
(58) Field of Search ..... 66/125 R, 64, 66/126 R, 127, 128, 129–133, 138, 146, 160, 161–163, 60 R; 364/470.12

(56) References Cited

U.S. PATENT DOCUMENTS

| | | | | |
|---|---|---|---|---|
| 1,893,808 | | 1/1933 | Spector . | |
| 3,861,176 | | 1/1975 | McWhirter et al. . | |
| 4,821,199 | * | 4/1989 | Kuhnert | 66/146 |
| 5,050,405 | | 9/1991 | Jacobsson . | |
| 5,353,610 | * | 10/1994 | Barea | 66/146 |
| 5,931,023 | * | 8/1999 | Branch et al. | 66/146 |
| 6,010,052 | * | 1/2000 | Leins et al. | 66/146 |

FOREIGN PATENT DOCUMENTS

| | | |
|---|---|---|
| 35 24 220 A1 | 1/1987 | (DE) . |
| 40 32 402 A1 | 4/1992 | (DE) . |

* cited by examiner

*Primary Examiner*—Danny Worrell
(74) *Attorney, Agent, or Firm*—Michael J. Striker

(57) ABSTRACT

For producing a knitted product on a flat knitting machine with simultaneous supply of two threads of different elasticities to needles of the machine, for each stitch to be formed the length of the thread of the higher elasticity to be supplied to a needle is calculated from the supplied length of a thread of the lower elasticity and the data about the material property of the thread of the higher elasticity, and a feeding device is controlled for the thread of the higher elasticity in correspondence with the calculated thread length to be supplied.

12 Claims, 2 Drawing Sheets

METHOD FOR PRODUCING A KNITTED ARTICLE ON A FLAT KNITTING MACHINE

BACKGROUND OF THE INVENTION

The present invention relates to a method of producing a knitted article on a flat knitting machine, and to a flat knitting machine for producing a knitted article.

There are a plurality of knitted articled in which threads of different elasticity are processed together. For example in supporting or compression hosiery the wearing comfort is obtained by a textile base thread of low elasticity and the definite supporting and compression force is provided by the clamping force of an elastic thread. The elastic threads can be composed of different materials, such as elastomers or rubber mixtures. They can be spun also from other threads. Depending on the material and the construction of the threads their elasticity differs when the pulling forces act on them by the thread guide of the knitting machine. For a uniform knitting image it is necessary, during supply of threads with different elasticity for the loop formation to the needles of a knitting machine to monitor that the threads of higher elasticity are inserted with lower tension in the needle hooks and distributed uniformly over the total knitted article width. Moreover, it is necessary to monitor that the both threads of different elasticity form a stitch of the same shape and size.

For round knitting machines, an arrangement has been developed which supplies the threads of higher elasticity to the thread guide with stress which is specific for it and the knitted article to be produced. The device has two parallel shafts which are driven in the same direction and on which the coil with the elastic thread lies with its periphery. The shafts are coupled with the drive of the knitting machine through a toothed belt. The rotary speed and thereby the peripheral speed of the shafts have a fixed ratio to the rotary speed of the knitting machine. In the event of high knitting speed, many threads are wound from the coil, and in the event of the low knitting speed correspondingly lower number of threads is wound from the coil. In the flat knitting machines this device however can not be used since there in one knitting row, stitches of different sizes can be formed and also the width of the individual stitch row can be different. A supply of thread with higher elasticity alone in dependence from the knitting speed is here not possible.

SUMMARY OF THE INVENTION

Accordingly, it is an object of the present invention to provide a method of producing a knitted article with a uniform supply of two threads having different elasticities to a needle, which can be used with a flat knitting machine and provides a completely uniform stitch image.

In keeping with these objects and with others which will become apparent hereinafter, one feature of present invention resides, briefly stated in a method of the above mentioned general type in for which each stitch to be formed the length of the thread with a higher elasticity supplied to a needle is calculated from the length of the thread of lower elasticity to be supplied and the data about the material properties of the thread of the higher elasticity, and a feeding device for the thread of the higher elasticity is controlled in correspondence with the calculated thread length to be supplied.

In accordance with this process for each stitch in particular the length of the elastic thread to be supplied is determined in dependence on its material properties as well as the supplied length of the thread of the lower elasticity. Thereby always an optimal thread supply for all pattern types and thread types is provided.

In accordance with a preferable embodiment of the method, an average factor is calculated from the data about the material property of the thread of the higher elasticity, it is multiplied with the length of the thread of the lower elasticity to obtain the length of the thread of the higher elasticity to be supplied.

The thread with the higher elasticity must be inserted with a substantially lower tension into the needle hook than the thread with the lower elasticity. This tension is provided in that the lower thread quantity corresponding to the average factor, than the thread of the lower elasticity, is supplied for the stitch formation. Moreover, the knitting direction can be taken into consideration, in that more threads of higher elasticity is supplied when the knitting direction is back from the feeding device for the thread of the higher elasticity and forward when the knitting direction is to the feeding device. In this way an optimal tension of the thread with the higher elasticity is guaranteed independently from the knitting direction.

The information required for calculation of the length of the thread of the higher elasticity to be supplied via the supplied length of the thread of the lower elasticity can be determined for example by a measuring device. The supplied length of the thread of the lower elasticity can be however also calculated from the data supplied by a machine control unit related to the corresponding stitch size of the thread of the lower elasticity, the stitch sequence, and the number of the stitches in the corresponding stitch row. A measuring device can be dispensed with. The both threads of different elasticities can be supplied with a common thread guide or also by separate thread guides without substantially changing the method.

The present invention also deals with a flat knitting machine which has at least one needle bed for performing the inventive method, and which has a coil for the thread of the lower elasticity, a feeding device of the thread of the higher elasticity, at least one thread guide for the both threads of different elasticities, a machine control unit and a computing and control unit for determination of the length of the thread of the higher elasticity to be supplied and for controlling the feeding device for the thread of the higher elasticity.

The feeding device, similarly to the feeding devices of the elastic threads in round knitting machines, can have two parallel feeding rollers of identical diameters which are driven in the same direction, and on which a coil with the thread of the higher elasticity lies with its periphery.

The feeding device can be provided with an electric motor which is coupled with the computing and control unit, whereby the peripheral speeds of the feeding rollers can be regulated in correspondence with the calculated length of the thread of the higher elasticity to be supplied.

Between the coil for the thread of the lower elasticity and the thread guide, in a known manner a thread tensioner can be arranged for a tension equalization in the event of abrupt speed changes of the thread guide. Moreover, a thread breakage sensor can be provided for the thread of the higher elasticity.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
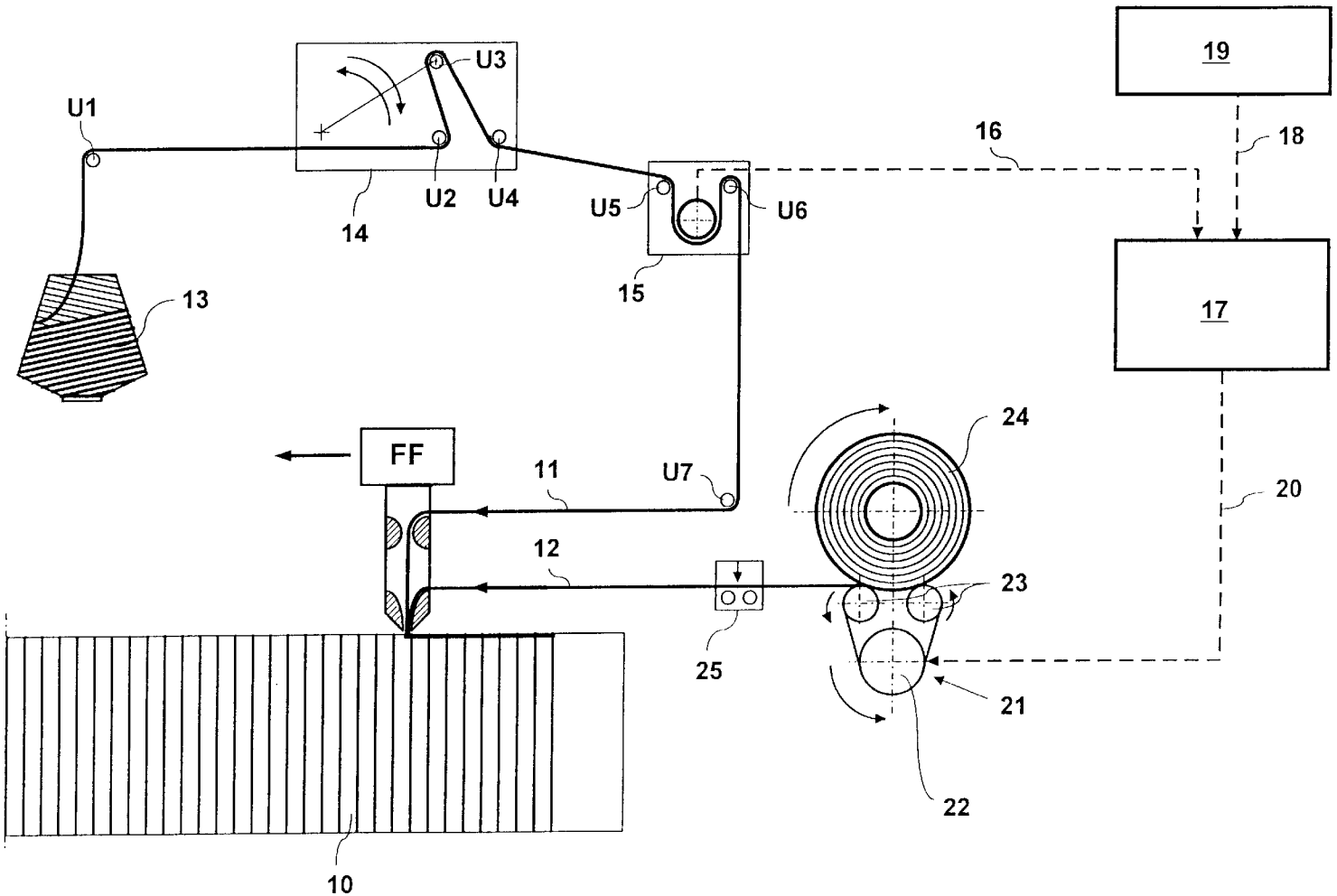
FIG. 1 is a schematic view of a first thread supply device in accordance with the present invention.

A needle bed of a flat knitting machine which is not illustrated in detail is identified with reference numeral 10 in FIG. 1. A thread of a lower elasticity 11 as well as a thread of a higher elasticity 12 are supplied by means of a thread guide FF to the needle bed 10. The thread of the lower elasticity 11 is pulled from a coil 13 and supplied through a thread tensioner 14 as well as a measuring device 15 to the thread guide FF through several deviating rollers U1–U7. The measuring device 15 continuously measures the length of the thread of the lower elasticity 11 required for a stitch, and transmits this value through a data line 16 to a computing and control unit 17. The computing and control unit 17 is connected through a data line 18 with a machine control unit 19 of the flat knitting machine as well as through a control line 20 with a feeding device 21 for the thread of the higher elasticity 12.

In addition to the information about the supplied length of the thread of the lower elasticity 11, the computing and control unit 17 receives from the machine control unit 19 the informations about the material properties of the thread of the higher elasticity 12 and computes from it the length of the thread of the higher elasticity 12 to be supplied, and also correspondingly controls an electric motor 20 for the feeding device 21 for the thread of the higher elasticity 12. The motor 22 drives two feeding rollers 23 of the same diameter, on which a coil 24 with the thread of the higher elasticity 12 lies with its periphery. Depending on the peripheral speed of the feeding roller 23, more or less thread of the higher elasticity 12 is supplied to the thread guide FF.

The thread of the higher elasticity 12 is supplied directly from the coil 24 without further thread tensioning devices or the like to the thread guide FF. A sensor 25 is provided in the thread supply for detecting thread breakages.

Figure 2:
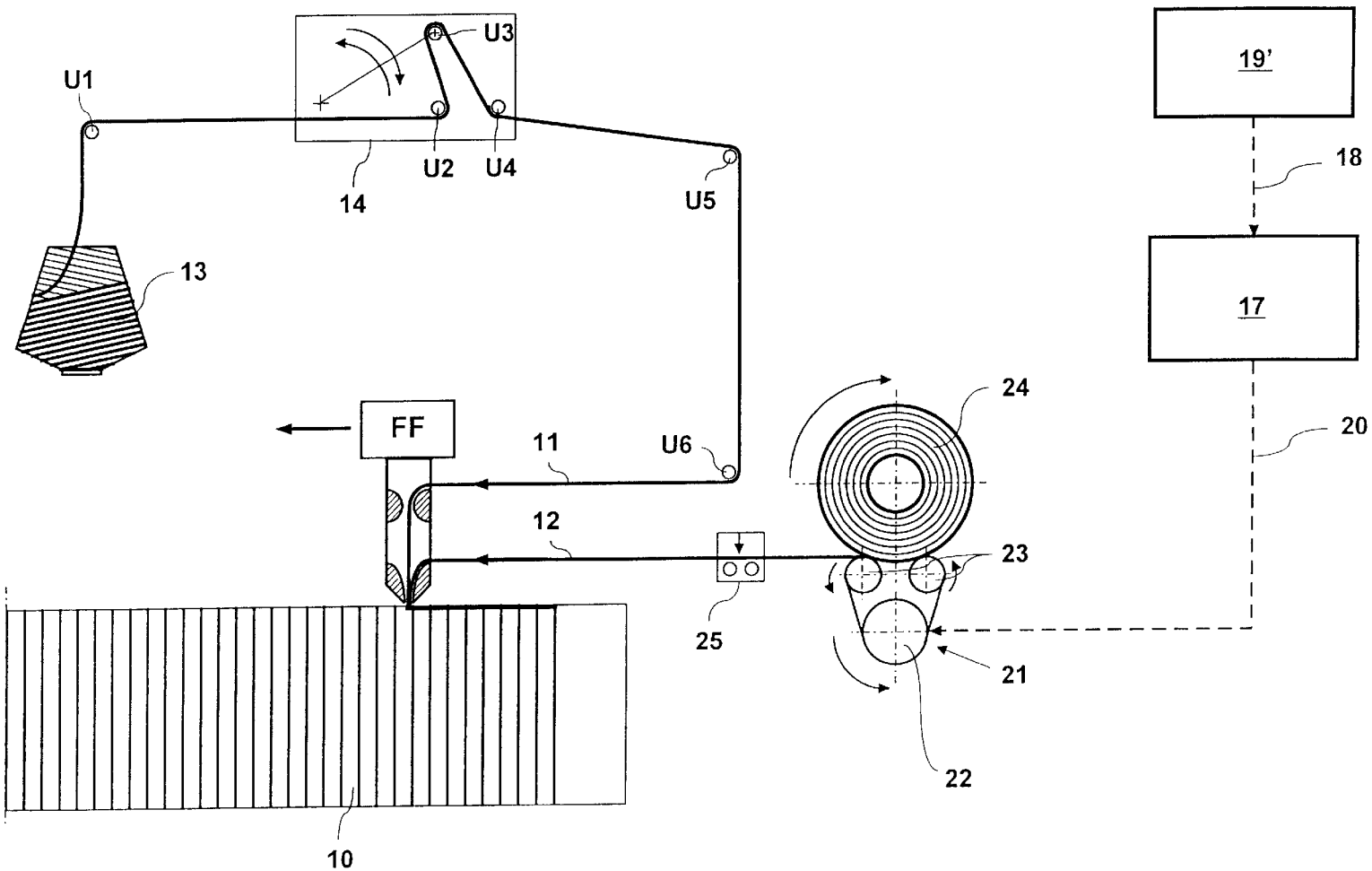
FIG. 2 is a schematic view of a second thread supply device in accordance with the present invention.

In contrast to the device of FIG. 1, the supply device of FIG. 2 has no measuring device 15 for measuring supplied length of the thread of the lower elasticity 11. Here the computing and control unit 17 obtains, in addition to the data about the yarn properties of the thread of the higher elasticity 12, also the information from a machine control unit 19' above the corresponding stitch sizes of the thread of the lower elasticity 11, the stitch sequence, and the number of the stitches in the knitting row, as well as about the knitting direction. The computing and control unit 17 calculates from them the length of the thread of the higher elasticity to be supplied, and correspondingly controls the feeding device 21 for the thread of the higher elasticity 12.

From the data about the yarn properties of the thread of the higher elasticity 12, an average factor is computed and multiplied with the supplied length of the thread of the lower elasticity 11 to obtain a length of the thread of the higher elasticity 12 to be supplied. From the knitting direction data the computing and control unit 17 recognizes whether the thread guide FF of the thread of the higher elasticity 12 moves from the supply devices 21 or to it. Thereby the thread quantity during the movement of the thread guide FF from the feeding device 21 can be increased, and during the movement to the supply device 21 can be reduced. It is therefore guaranteed that the thread of the higher elasticity 12 has always the optimal thread tension. With the thread of the lower elasticity 11, the thread tensioner 14 is used to provide a constant thread tension.

It will be understood that each of the elements described above, or two or more together, may also find a useful application in other types of methods and constructions differing from the types described above.

While the invention has been illustrated and described as embodied in method of producing a knitted article on a flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A method of producing a knitted article on a flat knitting machine, comprising the steps of simultaneously supplying two threads of different elasticities to needles of the flat knitting machine; computing for each stitch to be made a length of a thread of a higher elasticity to be supplied to a needles, exclusively from a supplied length of a thread of a lower elasticity and from data about a material property of the thread of the higher elasticity; and controlling a feeding device for the thread of the higher elasticity in correspondence with the calculated thread length to be supplied.

2. A method as defined in claim 1; and further comprising the step of calculating a mean factor from the data about the material property of the thread of the higher elasticity; and multiplying the mean factor with the length of the thread of the lower elasticity, to thereby obtain the length of the thread of the higher elasticity to be supplied.

3. A method as defined in claim 1; and further comprising the steps of supplying more threads of the higher elasticity when the knitting direction is from the feeding device for the thread of the higher elasticity than when the knitting direction is to the feeding device.

4. A method as defined in claim 1; and further comprising the step of determining the supplied length of the thread of the lower elasticity by a measuring device.

5. A method as defined in claim 1 and further comprising the steps of calculating the supplied length of the thread of the lower elasticity from data supplied from a machine control unit about a corresponding stitch size of the thread of the lower elasticity, a stitch sequence and a number of stitches in a knitting row.

6. A method as defined in claim 1; and further comprising the step of supplying the both threads of different elasticities to a common thread guide.

7. A flat knitting machine, comprising at least one needle bed; a coil for a thread of a lower elasticity; a feeding device for a thread of a higher elasticity; at least one thread guide for the both threads of different elasticities; a machine control unit; and a computing and control unit for determining a length of the thread of the higher elasticity to be supplied and controlling said feeding device for the thread of the higher elasticity.

8. A flat knitting machine as defined in claim 7, wherein said feeding device has two substantially parallel feeding rollers of a same diameter which are driven in a same direction, said coil with the thread of the higher elasticity abutting with its periphery on said feeding rollers.

9. A flat knitting machine as defined in claim 7, wherein said feeding device has an electric motor coupled with said computing and control unit.

10. A flat knitting machine as defined in claim 7; and further comprising a thread tensioner provided between said coil for the thread of the lower elasticity and said thread guide.

11. A flat knitting machine as defined in claim 7; and further comprising a thread length measuring device arranged between said coil for the thread of the lower elasticity and said thread guide and coupled with said computing and control unit.

12. A flat knitting machine as defined in claim 7; and further comprising a thread breakage sensor for the thread of the higher elasticity.

* * * * *